US007192329B2

(12) United States Patent
Lee

(10) Patent No.: US 7,192,329 B2
(45) Date of Patent: Mar. 20, 2007

(54) MULTI-FACET DECORATION ASSEMBLY

(75) Inventor: Chen-Tien Lee, DongGuan (CN)

(73) Assignee: Donguan Winjo Giftware Co., Ltd., DongGuan (CN)

( * ) Notice: Subject to any disclaimer, the term of this patent is extended or adjusted under 35 U.S.C. 154(b) by 193 days.

(21) Appl. No.: 10/985,469

(22) Filed: Nov. 9, 2004

(65) Prior Publication Data

US 2006/0099375 A1 May 11, 2006

(51) Int. Cl.
*A63H 33/08* (2006.01)

(52) U.S. Cl. ..... 446/116; 428/34.1; 428/8; 428/57; 52/81.1; 52/DIG. 10

(58) Field of Classification Search ..... 428/34.1, 428/11, 8, 9, 12, 57, 99; 52/DIG. 10, 81.1; 446/109, 108, 115, 116, 114
See application file for complete search history.

(56) References Cited

U.S. PATENT DOCUMENTS 5,183,430 A * 2/1993 Swann ..... 446/104

FOREIGN PATENT DOCUMENTS

GB 1387829 * 3/1975

* cited by examiner

*Primary Examiner*—Alexander S. Thomas

(57) ABSTRACT

A multi-facet decoration assembly is provided, comprising multiple polygonal grates with equilateral sides. Each corner of the polygonal grate has one catch pin and one slot pin disposed on the underside. This unique decoration ball assembly can be easily assembled by snapping multiple polygonal grates together so that all catch pins and slot pins on all polygonal grates are locked against each other. The decoration ball can be easily stored away when the polygonal grates and the panels are knocked down occupying only a small space, thus the storage and transportation costs can be reduced considerably.

7 Claims, 7 Drawing Sheets

MULTI-FACET DECORATION ASSEMBLY

BACKGROUND OF THE INVENTION

1. Field of the Invention

The present invention relates to a multi-facet decoration, and in particular to a decoration ball that is assembled from multiple polygonal grates with interlock mechanism, in which polygonal grates with catch pins and slot pins are linked with other corresponding polygonal grates together forming a hollow spherical structure.

2. The Related Art

Conventional ball-shaped decorations are popular for parties to enhance the festive atmosphere. Multi-facet decorations are also favored by discriminating designers, who often use them to decorate modern homes and offices.

Though these ball decorations are eye appeasing, few people pay attention to the interior material or the internal structure. Many different kinds of ball-shaped decorations are made available to the consumers, but most of them have hollow interior for the purpose of reducing the material cost and the body weight, in spite of that their bulky size creates a problem for the conventional packaging, as large boxes are needed to hold the spherical body, which directly affects their transportation and storage costs.

Some prudent designers then provide polygonal grates that can be assembled into ball or other spherical shapes using a set of identical grates. These polygonal grates are fabricated with connecting side boards along the edges, so that multiple nodes and cups on the surface of the side board are used to lock against each other when many polygonal grates are assembled to create a hollow spherical structure.

However, the polygonal grates with connecting side boards are not easy to manipulate, especially when many polygonal grates are to be cascaded to create an article with geometrical shape. The designer has to be very careful when assembling this type of ball structure, because it just takes a little pushing force on one side to have the assembly structure completely disintegrated.

Therefore, a structural modification is needed for the decoration set, so that the decoration set can be easily assembled to be ball or other spherical shapes, and stored away with a small space. The decoration set shall also promote efficient packaging to save on transportation and storage costs.

SUMMARY OF THE INVENTION

The first objective of the present invention is to provide a multi-facet decoration assembly, which is composed of multiple polygonal grates with catch pins and slot pins alternately arranged on the outer edges of each grate to link up other grates with similar interlock mechanism, together forming a hollow spherical structure.

The second objective of the invention is to provide a multi-facet decoration assembly using multiple polygonal grates that can be locked against each other when assembled to act as a truss for the hollow decoration structure, exhibiting strong rigidity almost equivalent to a solid structure.

The third objective of the invention is to provide a multi-facet decoration assembly that is easy to build by snapping the polygonal grates together, and easy to store away when the polygonal grates and panels are completely knocked down, thus the storage and transportation costs can be reduced considerably.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 2:
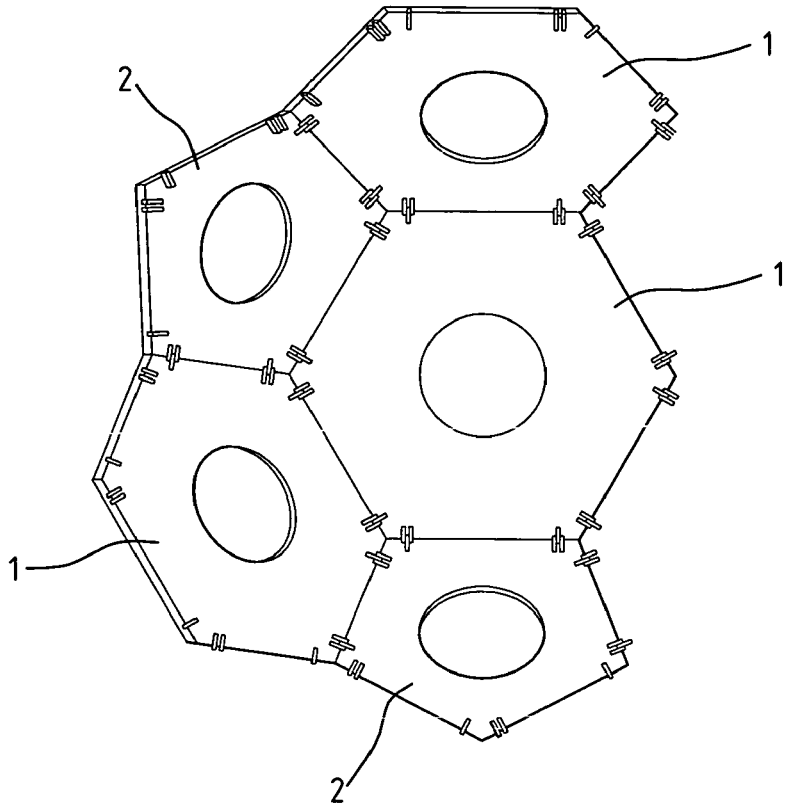
FIG. 2 is an exploded view of a section of the decoration ball assembly from the inner surface.
Figure 2:
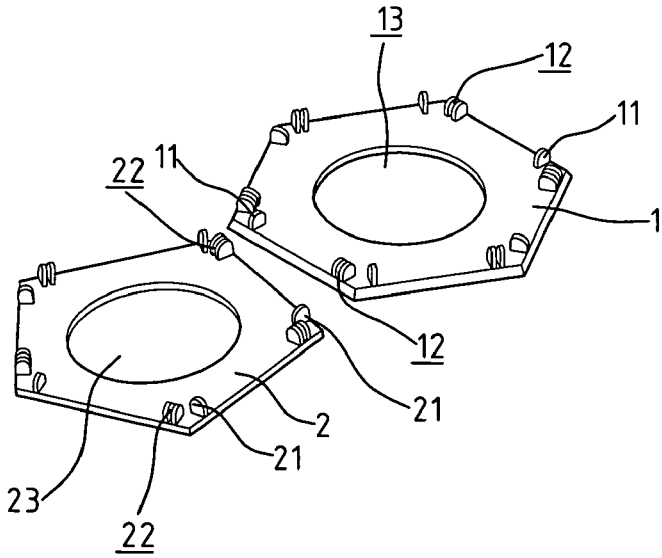
Figure 3:
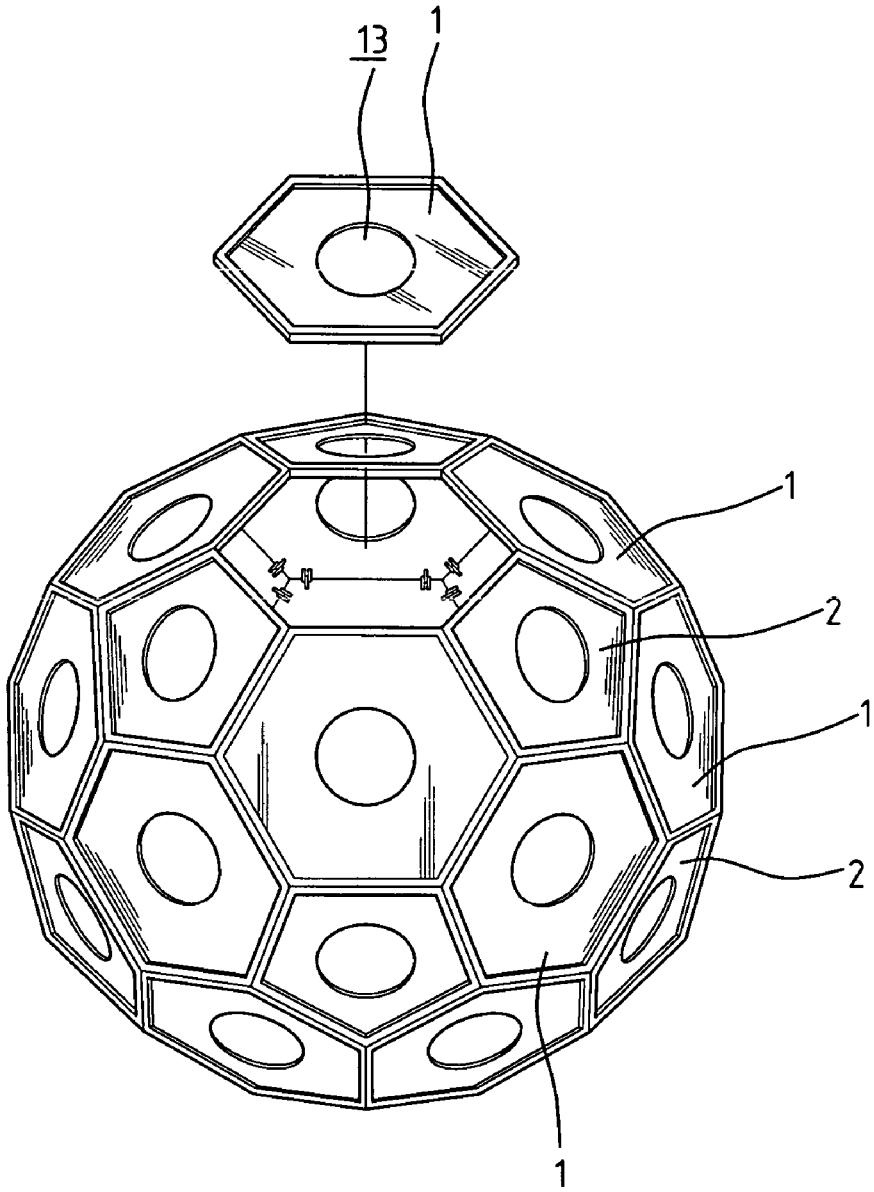
FIG. 3 is a diagram of the decoration ball assembly with one polygonal grate removed showing the internal structure.
Figure 4:
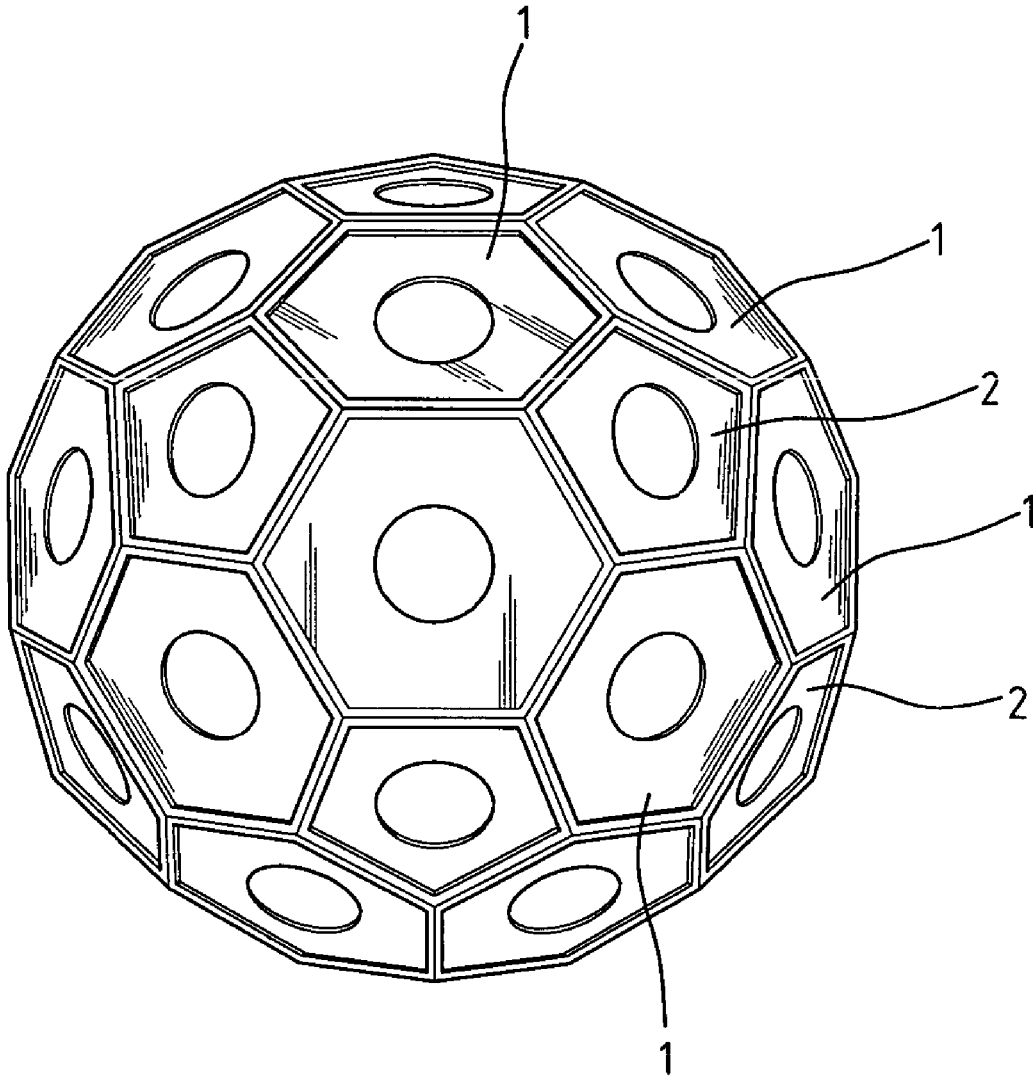
FIG. 4 is a perspective view of an assembled decoration ball assembly in accordance with the present invention.

Referring to FIGS. 2–4, a multi-facet decoration assembly is disclosed comprising multiple hexagonal grates 1 and pentagonal grates 2.

The hexagonal grate 1 is equilateral and slightly dished toward the center, and each corner of the hexagonal grate 1 has a catch pin 11 and a slot pin 12 alternately arranged on the underside, and the center of each polygonal grate 1 has a hole 13.

The pentagonal grate 2 is also equilateral and slightly dished toward the center, and each corner of the pentagonal grate 2 has a catch pin 21 and on the underside, and the center of each polygonal grate 2 has a hole 23.

The catch pin 11 on one hexagonal grate 1 is to be matched with a slot pin 12 on another hexagonal grate 1, or a slot pin 22 on one pentagonal grate 2 depending on the intended shape of the assembly structure, whereas the slot pin 12 on one hexagonal grate 1 is to be matched with a catch pin 11 on the other hexagonal grate 1 or a catch pin 21 on the pentagonal grate 2, depending on the intended shape of the assembly structure.

Figure 1:
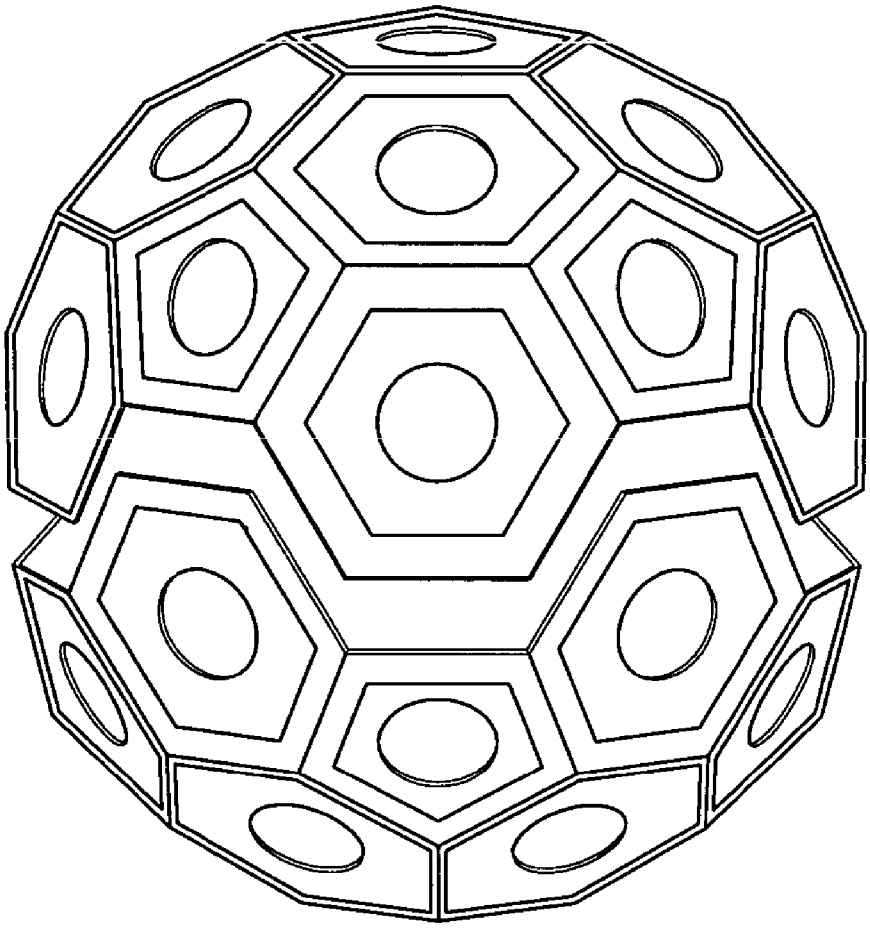
FIG. 1 is a conceptual diagram of the conventional decoration ball assembly.
Figure 5:
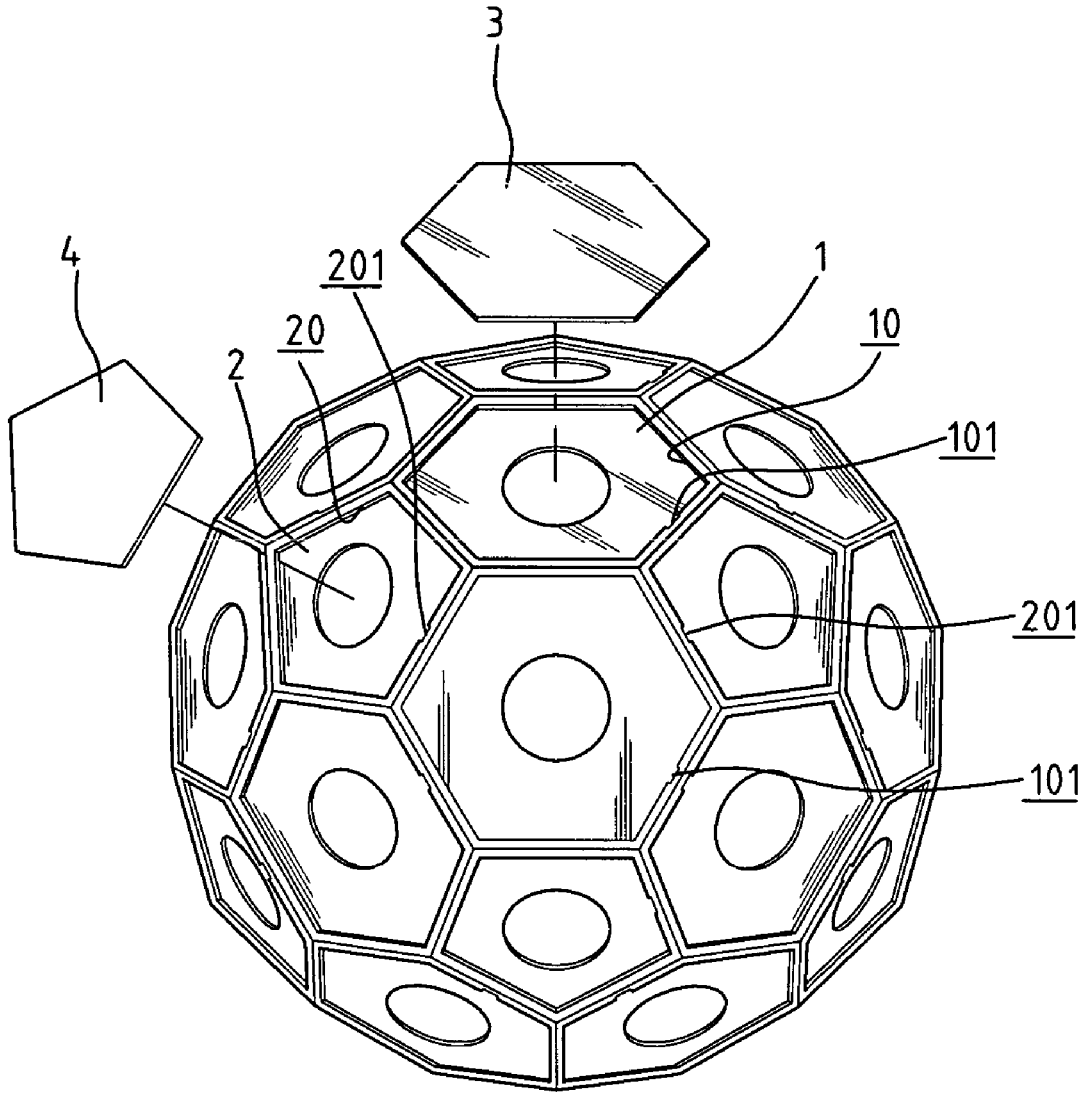
FIG. 5 shows a decoration ball assembly using hexagonal grates and pentagonal grates to form an interlocking structure.
Figure 6:
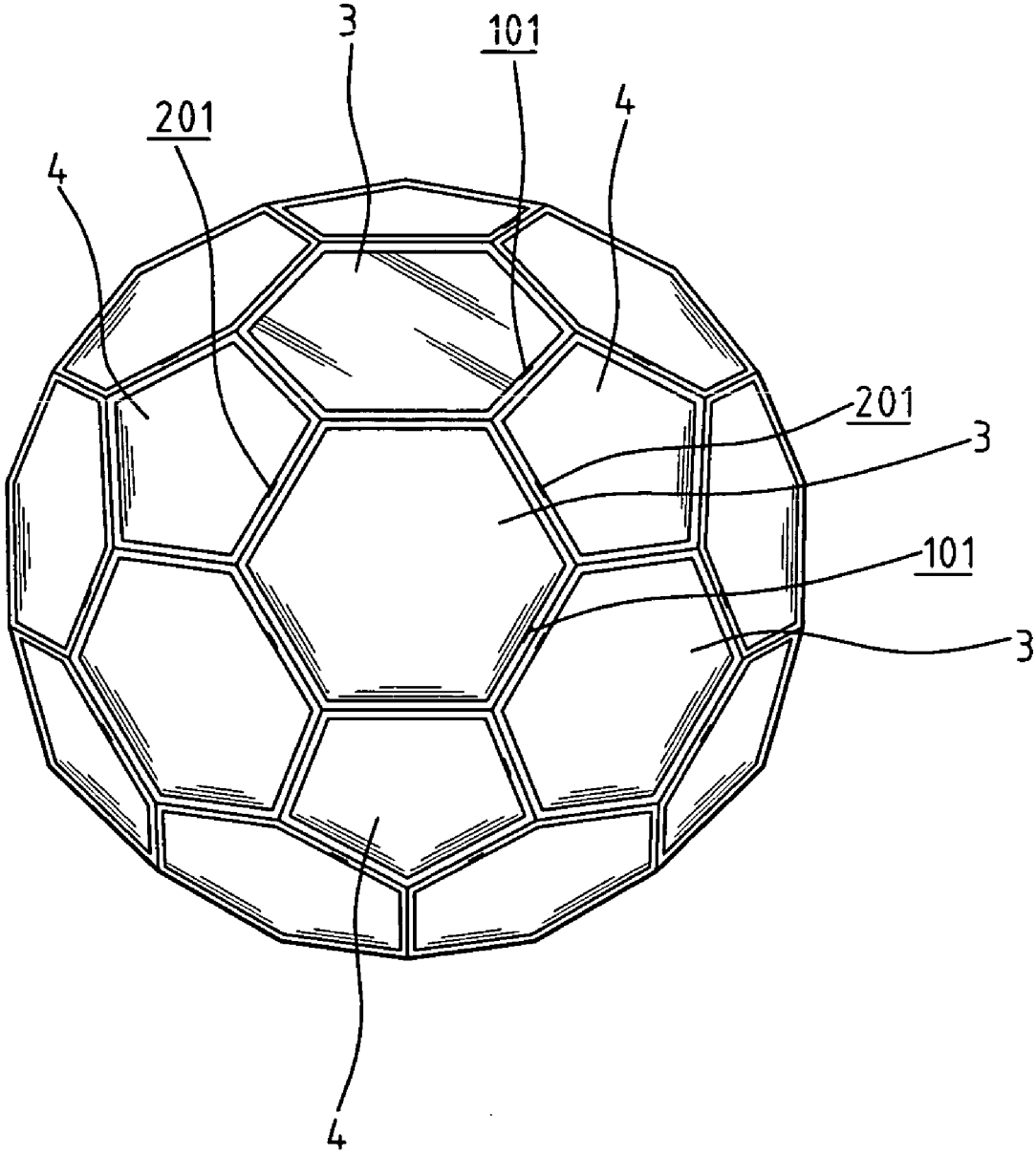
FIG. 6 shows a fully assembled decoration ball assembly using the polygonal grates in accordance with the present invention.

The decoration ball shown in FIG. 1 is assembled with a number of hexagonal grates 1 and a multiple number of pentagonal grates 2. When assembling the decoration ball, as in the present example, one hexagonal grate 1 is linked by five pentagonal grates 2 using five of the six sides, and one hexagonal grate 1 on the remaining side, so that all catch pins 11/21 and slot pins 12/22 on all polygonal grates are locked against each other when assembled to build a hollow spherical structure. However, the arrangement and the combination of the polygonal grates can be modified to build an assembly structure with different geometrical shape. Because the catch pins and slot pins are formed on the underside of a hexagonal or pentagonal grate, each slot pin is engaged with a catch pin in the interior of the assembled hollow ball-shaped structure. As can be seen in FIGS. 5 and 6, the hexagonal or pentagonal grates join together edge to edge, and the catch pins and slot pins are invisible from the outside of the decoration ball assembly of the present invention.

Referring to FIGS. 5 and 6, each hexagonal grate 1 has a raised band 10 on the outer rim to create a dished area in the center, where the band 10 has a gap 101 in the middle. The pentagonal grate 2 also has a raised band 20 on the outer rim to create a dished area in the center, where the band 20 has a gap 201 in the middle. A hexagonal panel 3 is inserted into the dished area of each hexagonal grate 1 and secured by the raised band 10 when the decoration structure is assembled. Likewise, a pentagonal panel 4 is fitted into the dished area of each pentagonal grate 2 and secured by the raised band 20.

The gaps 101, 201 on the polygonal grates are reserved for decoration designers who may insert a finger nail into the gap to pry open the surface panel in order to remove the surface panel over the polygonal grate.

Figure 7:
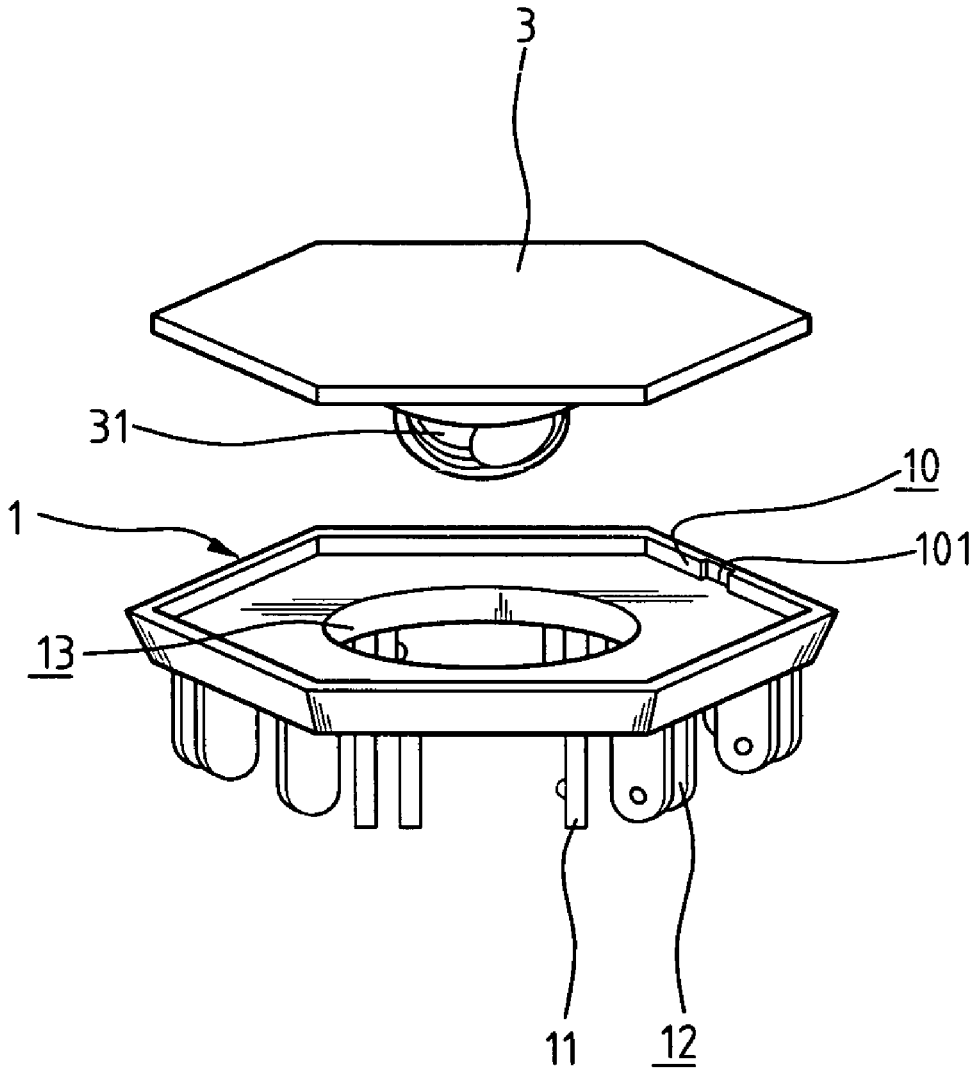
FIG. 7 shows the detailed structure of a polygonal grate and the surface panel.

The detailed structure of each hexagonal grate 1 is shown in FIG. 7, composed of six sides of equal length, a raised band 10 on the outer rim, a gap 101 in the middle of the raised band 10, and a hole 13 in the center of the dished hexagonal grate 1. The hexagonal grate includes a unique interlock mechanism, in which each corner has a catch pin 11 and a slot pin 12 disposed on the underside. The structure of the pentagonal grate 2 basically resembles the hexagonal grate 1, except that the pentagonal grate 2 has five sides of equal length.

When the decoration ball is assembled, in accordance with the preferred embodiment of the invention, each polygonal surface panel 3 shall be decorated with an insignia. The surface panels 3 may display other symbols or insignia according to the designer's choice. To secure the insignia, there is a clamping device 31 on the underside of the surface panel 3, which is to be inserted through the hole 13 on the polygonal grate 1 when the panel 3 is assembled onto the decoration ball. The clamping device 31 can be a commonly used clip to secure an insignia onto a button hole.

Likewise, a pentagonal panel 4 can be fitted with an insignia or other symbol as the hexagonal panel 3. The insignias or symbols on the polygonal surface panels can be collectively designed to create a decoration ball with a distinctive pattern.

From the foregoing discussion, the present invention has provided a unique multi-facet decoration assembly with hollow interior that can be easily assembled. The assembly procedure only takes few steps by snapping the polygonal grates together to cause the alternate catch pins and slot pins to be engaged with each other. The polygonal grates when linked together become a strong truss to support the assembly structure, thus a hollow decoration ball can be constructed using much less materials than its solid counterpart. The decoration ball assembly can be easily stored away with the polygonal grates and surface panels in the knock-down form, thereby the storage and transportation costs for the decoration ball can be considerably reduced.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A multi-facet decoration assembly, comprising multiple hexagonal grates and pentagonal grates, wherein:

each hexagonal grate is equilateral, slightly dished toward the center of the hexagonal grate, with a hole in the center, and a catch pin and a slot pin alternately arranged near each corner and on the underside of the hexagonal grate;

each pentagonal grate is also equilateral, slightly dished toward the center of the pentagonal grate, with a hole in the center, and a catch pin and a slot pin alternately arranged near each corner and on the underside of the pentagonal grate;

each catch pin on one hexagonal grate is to correspond with a slot pin on another hexagonal grate, or a slot pin on one pentagonal grate; and each slot pin on one hexagonal grate is to correspond with a catch pin on another hexagonal grate or a catch pin on one pentagonal grate, so that all catch pins and slot pins on all polygonal grates are locked against each other in order to build a hollow ball-shaped structure;

wherein each slot pin is engaged with a catch pin in the interior of the hollow ball-shaped structure, and the adjacent hexagonal grates or pentagonal grates join together edge to edge to make the slot pins and catch pins invisible from the outside of the multi-facet decoration assembly.

2. The multi-facet decoration assembly as claimed in claim 1, wherein the hexagonal grate has a raised band on the outer edges of the hexagonal grate to create a dished area in the center of the hexagonal grate, and the raised band has a gap in the middle of the raised band, whereby each hexagonal grate is fitted with a hexagonal surface panel and at least one hexagonal surface panel is formed with a clamping device protruded through the hole at the center of the fitting hexagonal grate into the interior of the hollow ball-shaped structure when the decoration assembly is assembled and secured by the raised band on all sides.

3. The multi-facet decoration assembly as claimed in claim 2, wherein each hexagonal panel is decorated with an insignia.

4. The multi-facet decoration assembly as claimed in claim 1, wherein the pentagonal grate has a raised band on the outer edges of the pentagonal grate to create a dished area in the center of the pentagonal, and the raised band has a gap in the middle of the raised band, whereby each pentagonal grate is fitted with a pentagonal surface panel and at least one pentagonal surface panel is formed with a clamping device protruded through the hole at the center of the fitting pentagonal surface panel into the interior of the hollow ball-shaped structure when the decoration assembly is assembled and secured by the raised band on all sides.

5. The multi-facet decoration assembly as claimed in claim 4, wherein each pentagonal panel is decorated with an insignia.

6. The multi-facet decoration assembly as claimed in claim 1, wherein each hexagonal panel is decorated with an insignia.

7. The multi-facet decoration assembly as claimed in claim 1, wherein each pentagonal panel is decorated with an insignia.

* * * * *